US010737829B1

(12) United States Patent
Wilson et al.

(10) Patent No.: US 10,737,829 B1
(45) Date of Patent: Aug. 11, 2020

(54) BOX FASTENER WITH IMPROVED CHARACTERISTICS

(71) Applicant: Eco-Latch Systems, LLC, Pewaukee, WI (US)

(72) Inventors: Jack David Wilson, Pewaukee, WI (US); Thomas Jon Wilcox, Waterford, WI (US); James Forsythe Wilson, III, Yardley, PA (US)

(73) Assignee: Eco-Latch Systems, LLC, Pewaukee, WI (US)

( * ) Notice: Subject to any disclaimer, the term of this patent is extended or adjusted under 35 U.S.C. 154(b) by 0 days.

(21) Appl. No.: 16/211,185

(22) Filed: Dec. 5, 2018

Related U.S. Application Data

(60) Provisional application No. 62/595,962, filed on Dec. 7, 2017.

(51) Int. Cl.
*B65D 5/64* (2006.01)

(52) U.S. Cl.
CPC ..... *B65D 5/643* (2013.01); *B65D 2101/0023* (2013.01)

(58) Field of Classification Search
CPC .... B65D 5/6647; B65D 5/6611; B65D 5/643; Y10T 24/334; Y10T 24/3439; Y10T 24/44538; Y10T 24/44026
USPC ..... 229/125.37, 129.39, 125.41, 125, 126; 40/647, 654
See application file for complete search history.

(56) References Cited

U.S. PATENT DOCUMENTS

| | | | | |
|---|---|---|---|---|
| 4,339,983 | A * | 7/1982 | Okamura | B25C 5/00 411/466 |
| 4,531,670 | A * | 7/1985 | Kupersmit | B65D 45/00 206/807 |
| 6,290,126 | B1 * | 9/2001 | Zudal | B65D 5/4283 229/125.39 |
| 8,840,010 | B2 | 9/2014 | Wilson | |
| 10,526,108 | B1 * | 1/2020 | Wilson | B65D 5/643 |
| 2012/0255954 | A1 * | 10/2012 | Barsness | B65D 5/643 220/324 |

* cited by examiner

*Primary Examiner* — Nathan J Newhouse
*Assistant Examiner* — Phillip D Schmidt
(74) *Attorney, Agent, or Firm* — Brannen Law Office, LLC

(57) ABSTRACT

The present invention relates to a box fastener. The box fastener can have sides with both a top piece and a bottom piece that are separated by a gap. The bottom piece is deformable along its length. The bottom piece has a hole that is either offset or enlarged compared to a corresponding hole in the top piece to accommodate the arcuate path of a curved piercing element of arm. A seal can be provided between the top and bottom piece. The piercing element optionally can puncture the seal and the seal can be fastened around the arm that is in the locked position. Unlocking of the arm will break the seal thereby revealing evidence of an unlocking event. The fastener has a bottom with grips having angled distal surfaces. The grips provide increasing levels of grip as the thickness of the box increases, and vice versa.

12 Claims, 9 Drawing Sheets

BOX FASTENER WITH IMPROVED CHARACTERISTICS

This United States utility patent application claims priority on and the benefit of provisional application 62/595,962 filed Dec. 7, 2017, the entire contents of which are hereby incorporated herein by reference.

BACKGROUND OF THE INVENTION

1. Field of the Invention

The present invention relates to a box fastener with improved characteristics, and in particular to a box fastener having sides with multiple pieces separated by a gap.

2. Description of the Related Art

Several methods of closing or sealing a box exist.

In one method, the corners of successive flaps are tucked under one another. While this may be a simple solution, it does not offer an effective seal and is subject to the limits of the box flap stiffness and integrity which can degrade over time and in particular when a corner is bent.

In another method, tape is used to seal the box. While this can be an effective sealing method, the tape is only a single-use product and its removal can lead to damage to the box.

In a further method, a device can be used to fasten or close the box. Several such devices exist.

None of the known devices have the unique advantages of the present invention. Thus, there exists a need for a box fastener with improved characteristics that solves these and other problems.

SUMMARY OF THE INVENTION

The present invention relates to a box fastener. The box fastener can have sides with both a top piece and a bottom piece that are separated by a gap. The bottom piece is deformable along its length. The bottom piece has a hole that is either offset or enlarged compared to a corresponding hole in the top piece to accommodate the arcuate path of a curved piercing element of arm. A seal can be provided between the top and bottom piece. The piercing element optionally can puncture the seal and the seal can be fastened around the arm that is in the locked position. Unlocking of the arm will break the seal thereby revealing evidence of an unlocking event. The fastener has a bottom with grips having angled distal surfaces. The grips provide increasing levels of grip as the thickness of the box increases, and vice versa.

According to one advantage of the present invention, the fastener has a top with two sides. Each of the sides has a base with a top piece and a bottom piece, with a gap there between. Advantageously, particularly with relatively thick boxes, the bottom piece can deform to accommodate the increased thickness while the top piece remains flat atop the box. This prevents the end of the fastener from separating from the box creating catch points.

According to another advantage of the present invention, the bottom piece can have a hole that is either enlarged relative to the top piece hole or offset laterally closer to the fastener center compared to the top piece hole to accommodate the arcuate path of the curved piercing element.

According to a further advantage of the present invention, the gap between the top and bottom pieces can accommodate a seal. The seal can be placed between the top and bottom pieces prior to the arm being moved to the locked position (in embodiment where seal is pierced). The piercing element can pierce the seal as the arm is being locked. Then, the ends of the seals can be joined above or on side of the arm. Unlocking of the arm breaks the seal providing evidence of an unlocking event. In an alternative embodiment, the seal can be located between the piercing element and a gap wall end and still be joined above or on side of the locked arm. The seal, in this embodiment, can be placed through the gap either before or after the arm is locked.

According to a still further advantage of the present invention, grips are provided on the upper surface of the bottom sides. Each grip can be comprised of two converging walls. The outer or distal wall can be angled towards the fastener center. This allows the end of the flap to slide relative to the angled wall past the grip during insertion instead of abutting the grip.

According to a still further advantage yet of the present invention, the thicker the box flaps, the more aggressive the grips engage the flaps. This is due to the spring force provided by the deformed sides that is generated as a result of the deformation.

According to another advantage of the present invention, the fastener can have two, one or no arms. These three options can be made in one manufacturing method without any secondary operations (i.e. grinding or cutting) and with the same tooling. This is advantageously accomplished by having a top hub wherein each arm is built off of the hub. The injection ports to either side can be selectably opened or closed depending upon the number of arms desired.

According to a still further advantage yet of the present invention, better pinch characteristics are provided on account of the hub as the arms are joined to the top of the hub without sharp angles. Further, the hub allows the two side arms to have a single continuous upper surface. A continuous top surface avoids pitfalls that could be associated with having a void between the sides such as creating a catch point.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
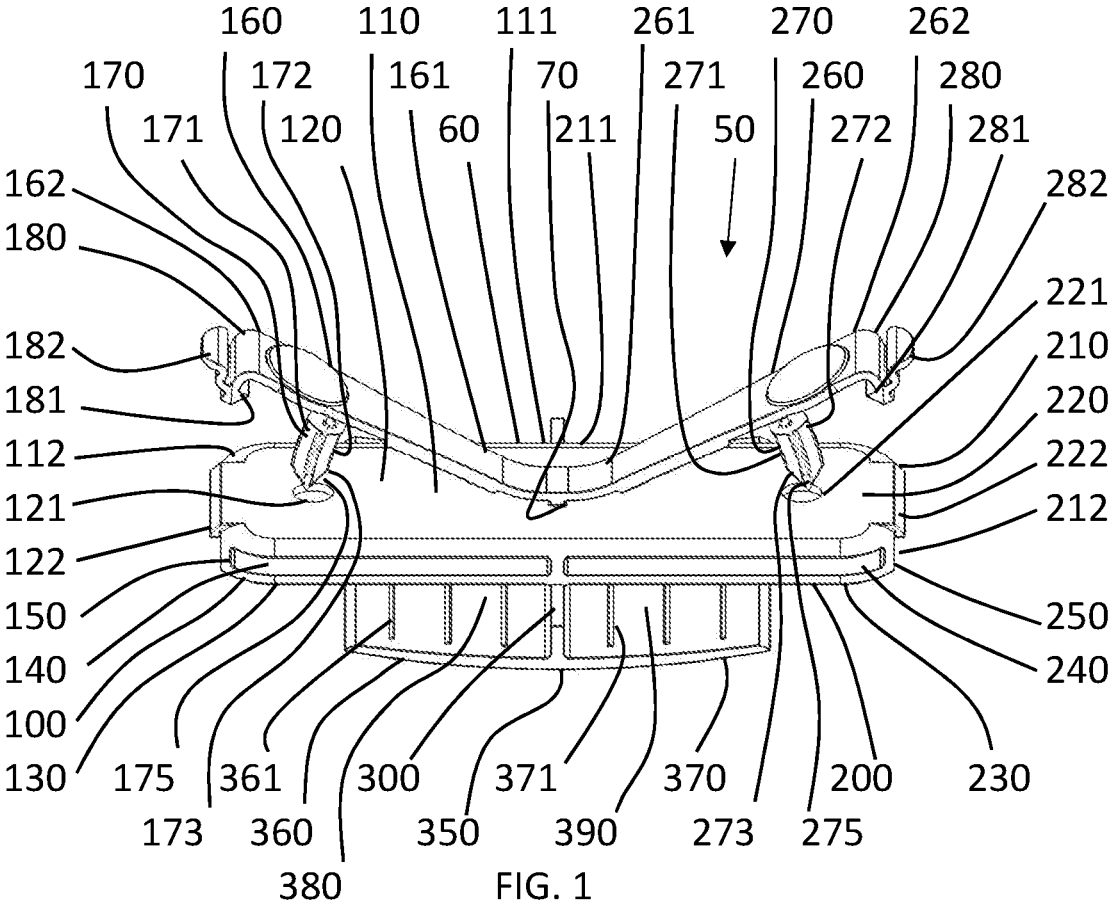
FIG. 1 is a perspective view showing an embodiment of the present invention.
Figure 2:
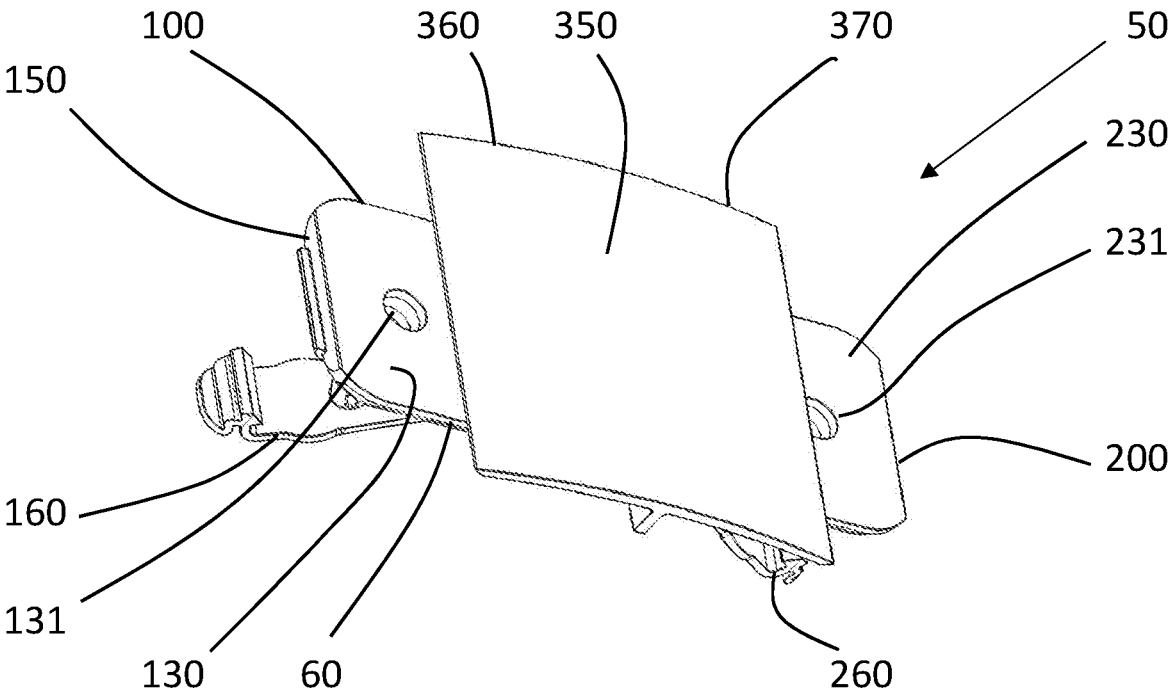
FIG. 2 is an alternative perspective view showing the embodiment illustrated in FIG. 1.
Figure 3:
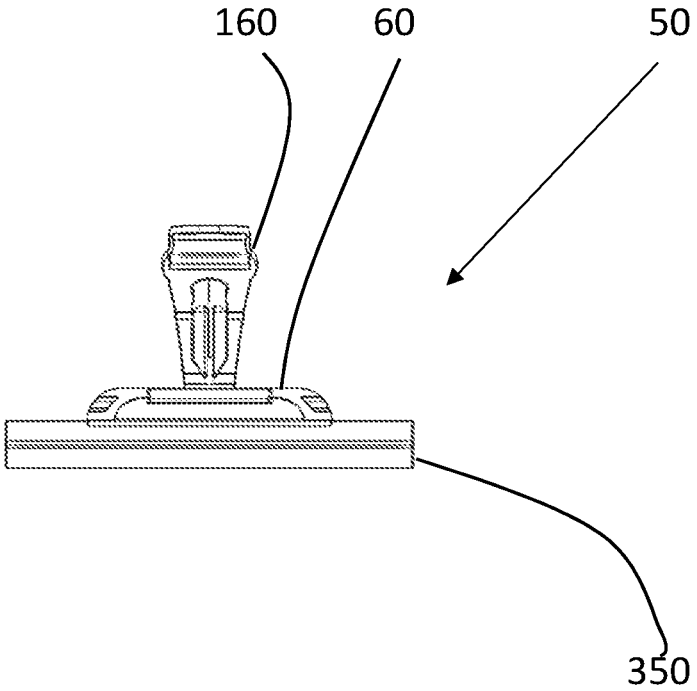
FIG. 3 is an end view of the embodiment illustrated in FIG. 1.
Figure 4:
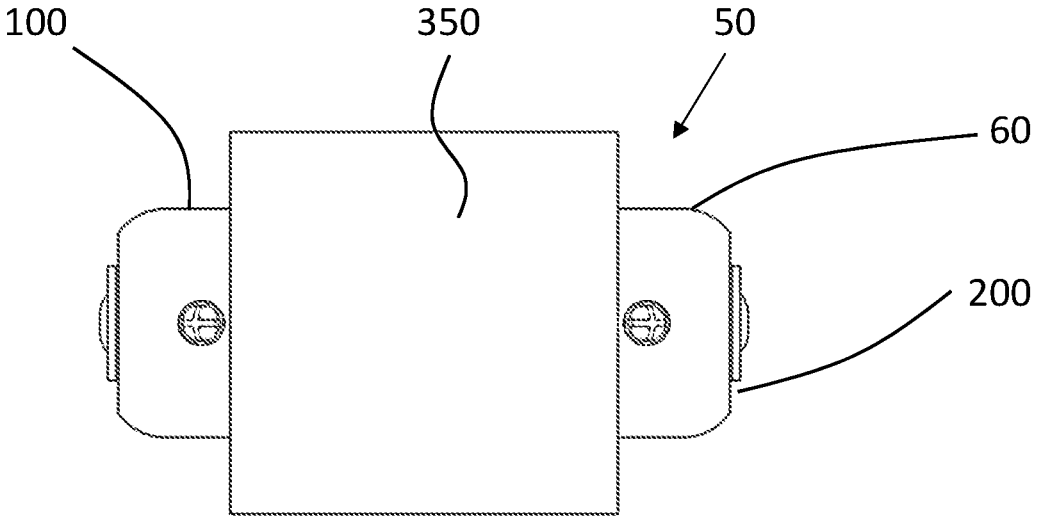
FIG. 4 is a bottom view of the embodiment illustrated in FIG. 1.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

The embodiments of the present invention are useful to secure a box 5 in a closed position. An exemplary box 5 is illustrated in FIGS. 15-18. The box 5 has a top 10 with outer flaps 11 and 12, respectively. The outer flaps 11 and 12 are sometimes referred to as major flaps. The box 5 also has inner flaps that are sometimes referred to as minor flaps. In a closed position, the major flaps 11 and 12 are flat at the top 10 of the box and lie in planes parallel to each other. A bottom 15 is also provided, and is similar in structure to the box top 10. The box 5 further has sides 20, 21, 22 and 23 respectively. It is appreciated that the boxes for use with the present invention can be made of various materials (such as card board, plastic, or otherwise) and that the thicknesses of the parts (in particular, the flaps) of the box can vary without departing from the broad aspects of the present invention.

Turning now to FIGS. 1-9, it is seen that a preferred embodiment of the present invention is illustrated. A fastener 50 is provided having a top 60 and a bottom 350 separated by a web 300. Each of these parts are described below.

The top 60 has a hub 70 that is centrally aligned on the top 60. The top 60 is preferably symmetrical about the hub 70 and has two sides 100 and 200.

Side 100 has a base 110 with two ends 111 and 112. The base has a top piece 120 and a bottom piece 130. The top piece 120 lies in a top piece plane and has a hole 121 and a flange 122. The bottom piece 130 lies in a bottom piece plane and has a hole 131. The top piece plane is preferably parallel to the bottom piece plane. Hole 131 of the bottom piece is preferably either enlarged with a perimeter wall closer to the hub, or similarly sized but positioned closer to the hub 70 than hole 121 of the top piece 120. A gap 140 exists between the top piece 120 and the bottom piece 130. The gap 140 is a constrained cavity as it is bound by the hub 70 at one end and an end wall 150 at the other end. The cavity is open on sides that are oriented in directions generally perpendicular to the gap's longitudinal axis.

An arm 160 is provided having ends 161 and 162, respectively. A tooth 170 having a body 171 with a curved shape is near end 162. The body has two ends 172 and 173, respectively. A piercing element 175 is at the end 173 of the body 171. A lock 180 having a flange 181 and a release 182 is at end 162 of the arm 160. The arm 160 can be in either an unlocked position or a locked position. In the locked position, the piercing element is through both hole 121 in the top piece 120 and hole 131 in the bottom piece. Further, flange 181 of the lock 180 engages flange 122 of the top piece 120 to hold the arm in the locked position. The piercing element travels in an arcuate path to move to and from the locked position as the arm swings about the point where the arm 160 and hub 70 intersect. In this regard, a hole having a diameter at least as large as the tooth body 171 is through both the top piece 120 and bottom piece 130 at the same linear distance from the intersection of the arm 160 and hub 70. A user can use the release 182 to disengage the flange 181 of the arm 160 from flange 122 of the top piece 120.

Side 200 is preferably a mirror image to side 100. Side 200 has a base 210 with two ends 211 and 212. The base has a top piece 220 and a bottom piece 230. The top piece 220 lies in a top piece plane and has a hole 221 and a flange 222. The bottom piece 230 lies in a bottom piece plane and has a hole 231. The top piece plane is preferably parallel to the bottom piece plane. Hole 231 of the bottom piece is preferably either enlarged with a perimeter wall closer to the hub, or similarly sized but positioned closer to the hub 70 than hole 221 of the top piece 220. A gap 240 exists between the top piece 220 and the bottom piece 230. The gap 240 is a constrained cavity as it is bound by the hub 70 at one end and an end wall 250 at the other end. The cavity is open on sides that are oriented in directions generally perpendicular to the gap's longitudinal axis.

An arm 260 is provided having ends 261 and 262, respectively. A tooth 270 having a body 271 with a curved shape is near end 262. The body has two ends 272 and 273, respectively. A piercing element 275 is at the end 273 of the body 271. A lock 280 having a flange 281 and a release 282 is at end 262 of the arm 260. The arm 260 can be in either an unlocked position or a locked position. In the locked position, the piercing element is through both hole 221 in the top piece 220 and hole 231 in the bottom piece. Further, flange 281 of the lock 280 engages flange 222 of the top piece 220 to hold the arm in the locked position. The piercing element travels in an arcuate path to move to and from the locked position as the arm swings about the point where the arm 260 and hub 70 intersect. In this regard, a hole having a diameter at least as large as the tooth body 271 is through both the top piece 220 and bottom piece 230 at the same linear distance from the intersection of the arm 260 and hub 70. A user can use the release 282 to disengage the flange 281 of the arm 260 from flange 222 of the top piece 220.

Figure 5:
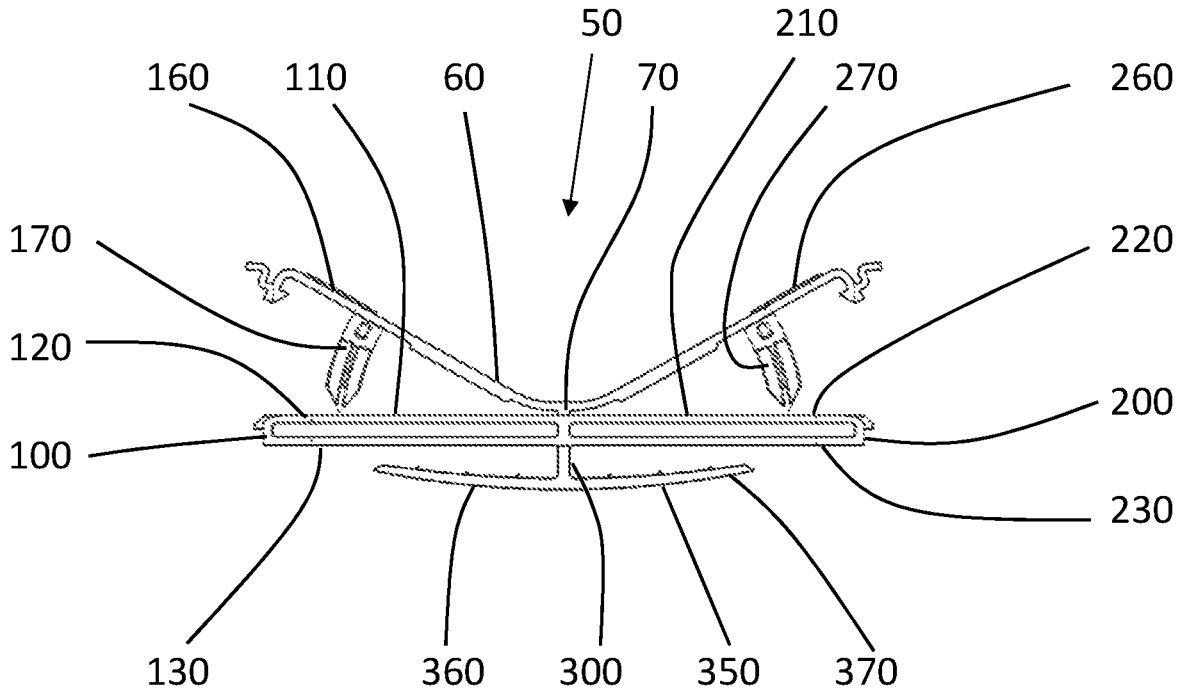
FIG. 5 is a side view of the embodiment illustrated in FIG. 1 showing both arms in unlocked positions.
Figure 6:
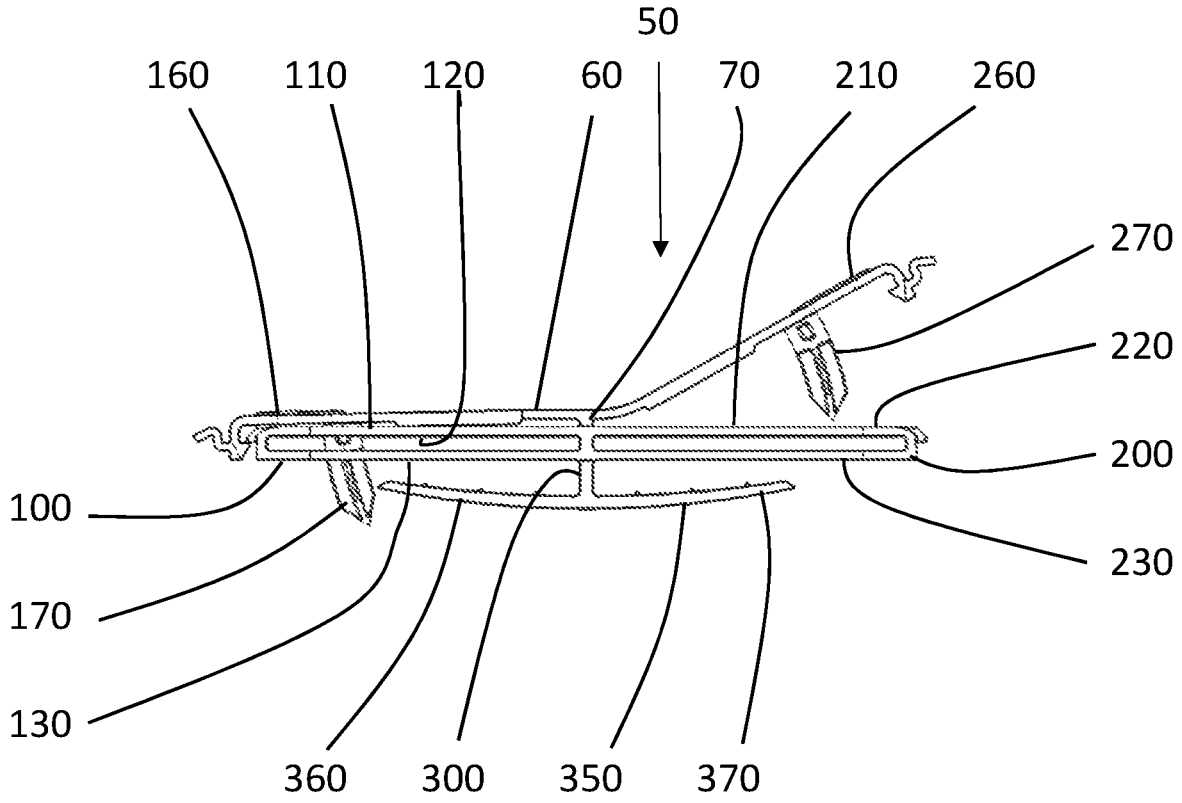
FIG. 6 is similar to FIG. 5, but shows one arm in the locked position.
Figure 7:
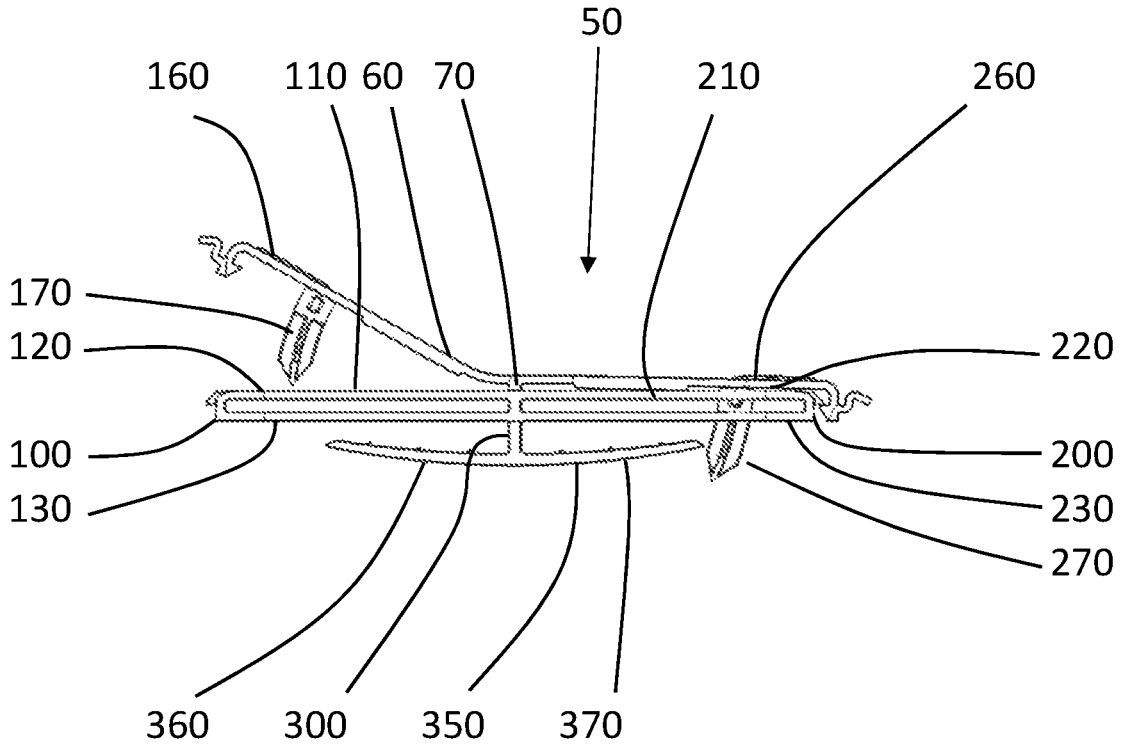
FIG. 7 is similar to FIG. 5, but shows one arm in the locked position.

Both arms 160 and 260 are shown in the unlocked (and fully open) position in FIG. 5. Arm 160 is shown in the locked position and arm 260 is shown in the unlocked position in FIG. 6. Arm 260 is shown in the locked position and arm 160 is shown in the unlocked position in FIG. 7. Both arms 160 and 260 are shown in the locked position in FIG. 8.

Figure 8:
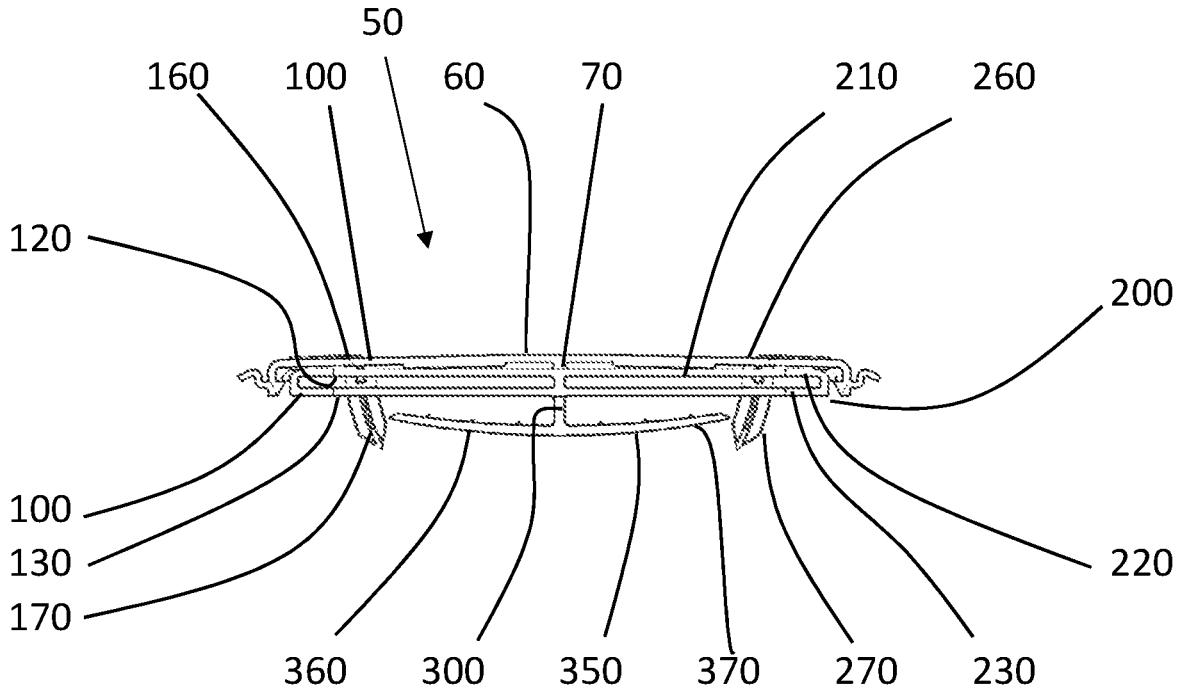
FIG. 8 is similar to FIG. 5, but shows both arms in the locked position.
Figure 9:
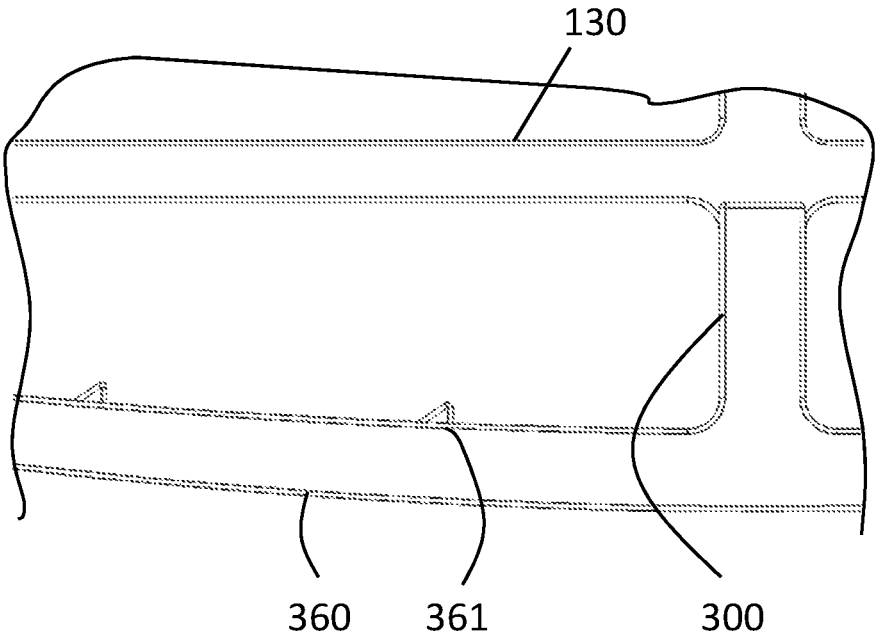
FIG. 9 is a close-up end view showing grips on one of the bottom sides.

Arms 160 and 170 have tops that are formed of a continuous surface. In use, when arms are in the locked position as seen in FIG. 8, the continuous top surface is smooth and accordingly unlikely to act as a catch for adjacent objects. Put another way, an object striking or contacting the top surface of the arms is likely to slide relative to the fastener instead of jarring the fastener.

The bottom 350 is separated from the top 60 by the web 300. The bottom has a first side 360 with grips 361. The bottom side 360 and the side 100 of the top 60 cooperate to form a pocket 380. There are preferably three grips 361 on the side 360. The grips are preferably linear along their longitudinal axis and are preferably parallel to each other. As seen in FIG. 8, the grip 361 has a generally triangular profile with the interior surface being generally perpendicular to the bottom and the distal surface being angled with respect to the bottom. In one embodiment, the angle of the distal surface of the grip can be approximately 45 degrees from vertical. However, it is appreciated that the angle can be greater or smaller without departing from the broad aspects of the present invention. The angled face allows for box flaps to be easily inserted into pocket 380 of the fastener as the end of the flap glides over the angled face instead of abutting it. The perpendicular face securely grips the flaps that are received within the fastener.

The bottom also has a second side 370 with grips 371. The second bottom side 370 and the side 200 of the top 60 cooperate to form a pocket 390. There are preferably three grips 371 on the side 370. The grips are preferably linear along their longitudinal axis and are preferably parallel to each other. The grips 371 have a generally triangular profile with the interior surface being generally perpendicular to the bottom and the distal surface being angled with respect to the bottom. In one embodiment, the angle of the distal surface of the grip can be approximately 45 degrees from vertical. However, it is appreciated that the angle can be greater or smaller without departing from the broad aspects of the present invention. The angled face allows for box flaps to be easily inserted into pocket 390 of the fastener as the end of the flap glides over the angled face instead of abutting it. The perpendicular face securely grips the flaps that are received within the fastener.

In the preferred embodiment, there are four contact points with respect to each pocket (end of the sides plus three grips). It is appreciated that there can be more or fewer contact points without departing from the broad aspects of the present invention. It is further appreciated that while the fastener is preferably symmetrical, that the fastener does not need to be symmetrical.

Figure 15:
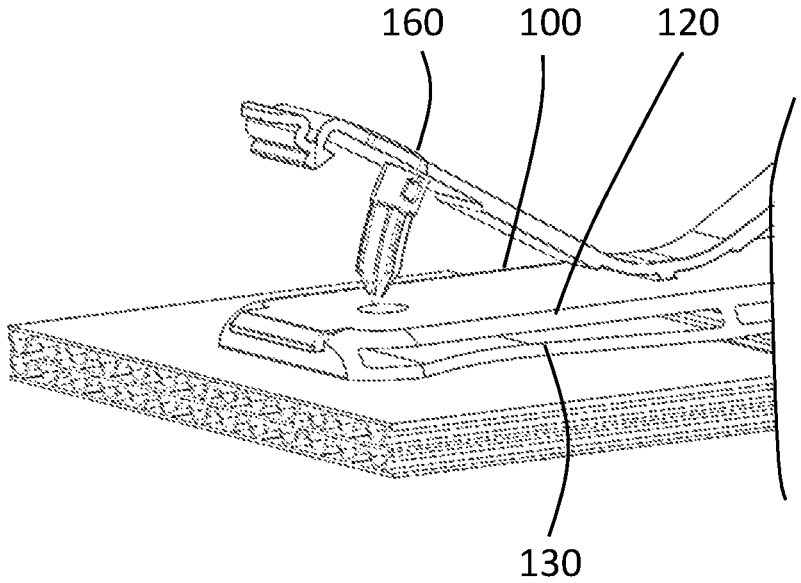
FIG. 15 is a perspective view of the present invention being used with a thick box flap wherein the bottom piece of the top side deforms to accommodate the box flap and the top piece remains flat.

The bottom sides 360 and 370 are preferably curved so that in an undeformed state they are closer to the top 60 at their respective distal ends. The pockets can accommodate flaps of varying thicknesses. In this regard, there is a progression of contacts with respect to the flaps. Thin flaps are engaged by the side ends. Alternatively, when the flaps have increased thickness, one or more of the grips can be engaged as the sides deform. The greater the deformation, the greater the number of grips that are engaged and the greater the aggressiveness of the grips as the spring force of the deformed sides increase. With oversized flaps, the bottom piece 130 of the top 60 can deform to accommodate the extra thickness as seen in FIG. 15. It is also seen that the top piece 120 remains flat even when the bottom piece 130 deforms. Side 200 can behave similar to side 100 with respect to accommodating oversized flaps.

Figure 16:
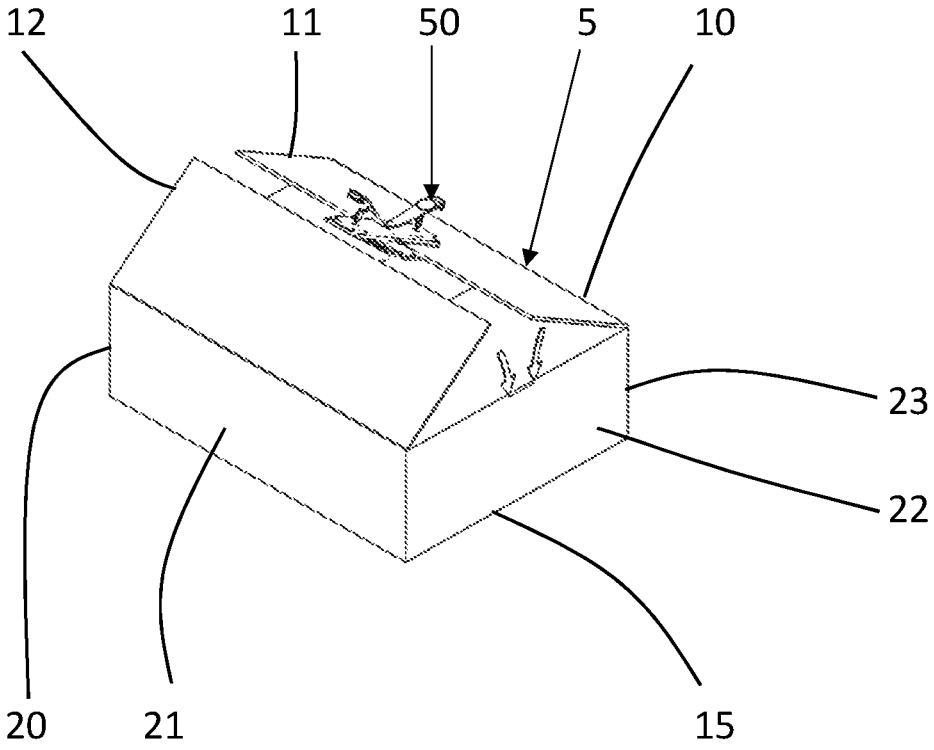
FIG. 16 is a perspective view showing the fastener being inserted onto a flap.
Figure 17:
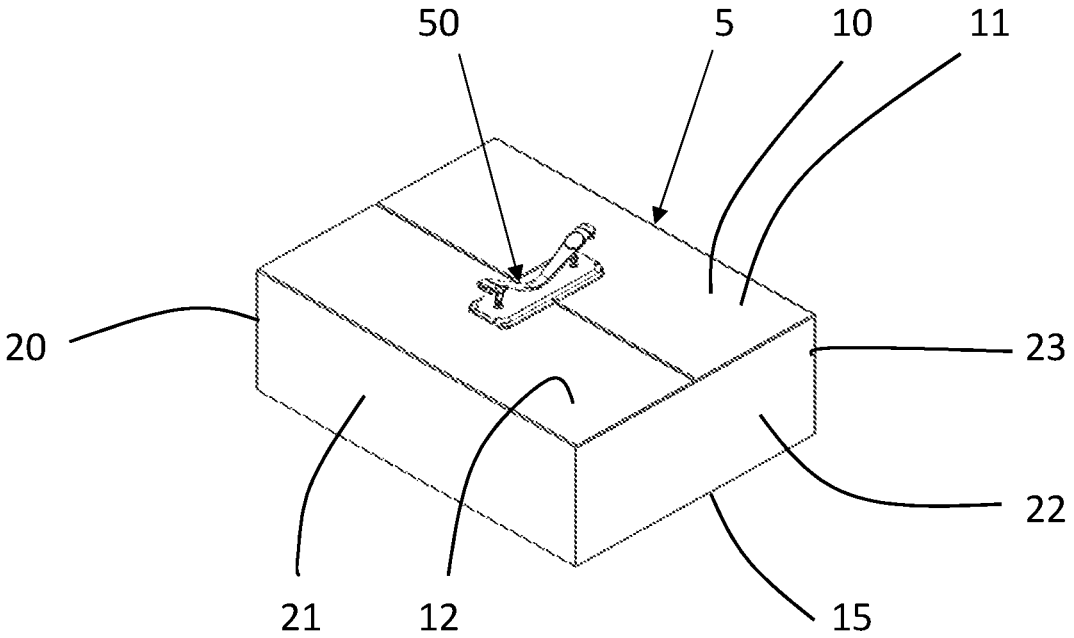
FIG. 17 is similar to FIG. 16 but shows the fastener being connected to both flaps with the arms unlocked.
Figure 18:
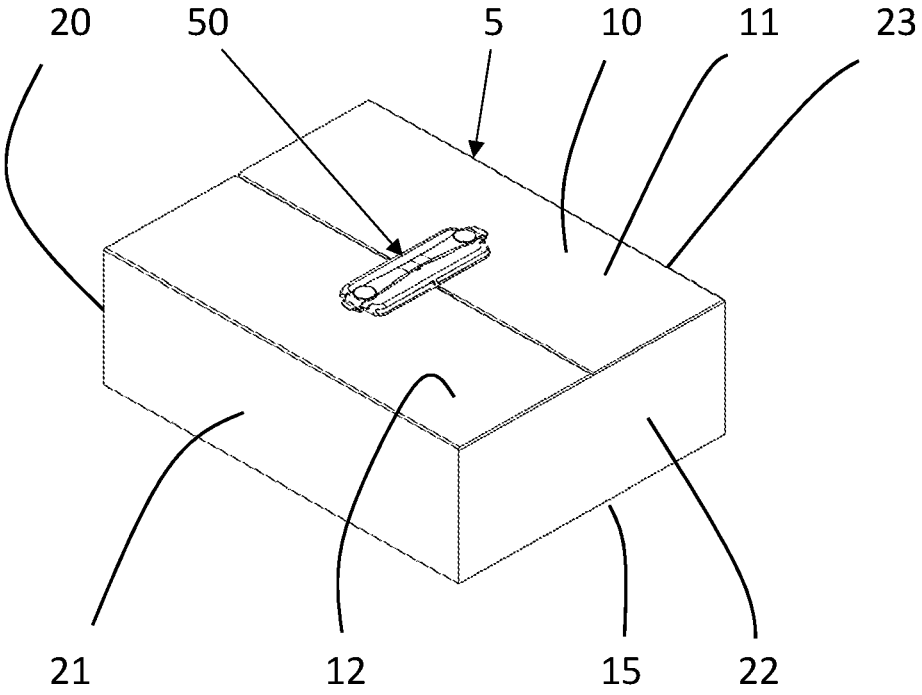
FIG. 18 is similar to FIG. 17 but shows the arms in the locked position.

The steps of using the fastener 50 to secure a box 5 are illustrated in FIGS. 16-18. The fastener 50 is slid first onto one flap (FIG. 15) wherein it is received within a pocket. The second flap is then slid into the opposite pocket (FIG. 17). Lastly, the arms are locked to lock the fastener in place (FIG. 18).

Figure 13:
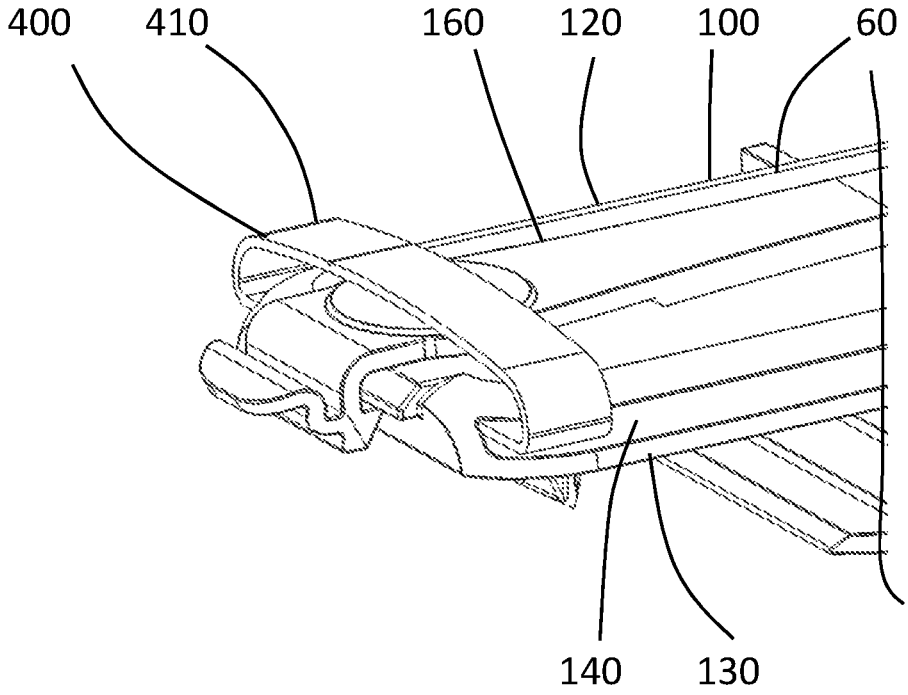
FIG. 13 is a perspective view of the present invention being used with a seal.
Figure 14:
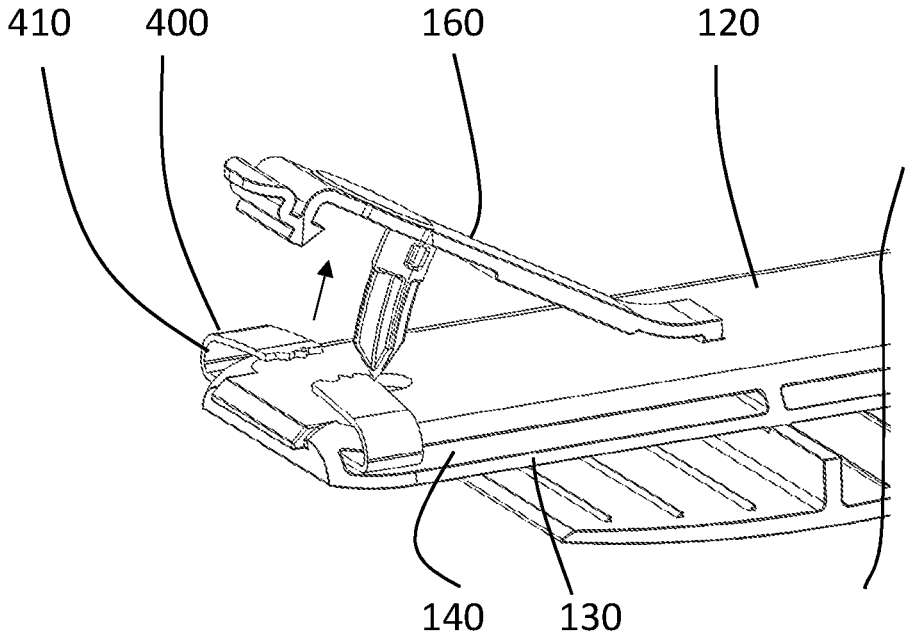
FIG. 14 is similar to FIG. 13, but shows the arm moved to an unlocked position and the seal broken.

A seal 400 can be used with the present invention to provide evidence of tampering or opening. One preferred seal 400 is a band or tape than can be sealed to itself. It is appreciated that other types of seals could be used without departing from the broad aspects of the present invention. The seal 400 can be inserted through the gap 140 or 240. The arm 160 or 260 can be locked and the seal can be affixed to itself in close proximity to the arm. The piercing element may or may not puncture the seal 400. The seal can be inserted through the gap after the arm is closed when the piercing element does not pierce the seal. The seal, when not punctured, is preferably bound by the piercing element and the end wall to prevent the seal from sliding all the way to the hub. The seal 400 is shown in position in FIG. 13. The arm is unlocked and the seal is shown in a broken state in FIG. 14.

Figure 10:
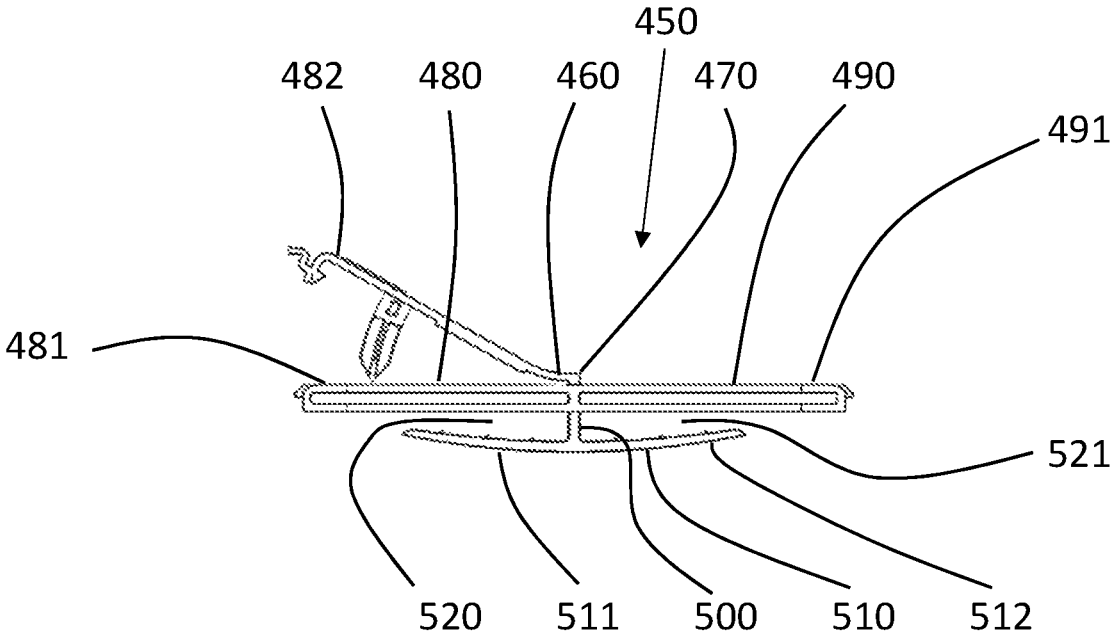
FIG. 10 is a side view of an alternative embodiment of the present invention with one arm.

Turning now to FIG. 10, it is seen that a one-armed embodiment of a fastener 450 is illustrated. The fastener 450 has a top 460 with a hub 470. The hub 470 separates a first side 480 having a base 481 and an arm 482 from a second side 490 having a base 491 without an arm. A web 500 separates the top 460 from a bottom 510. The bottom has two sides 511 and 512. Side 511 and side 480 define a pocket 520. Side 512 and side 490 define a pocket 521.

Figure 11:
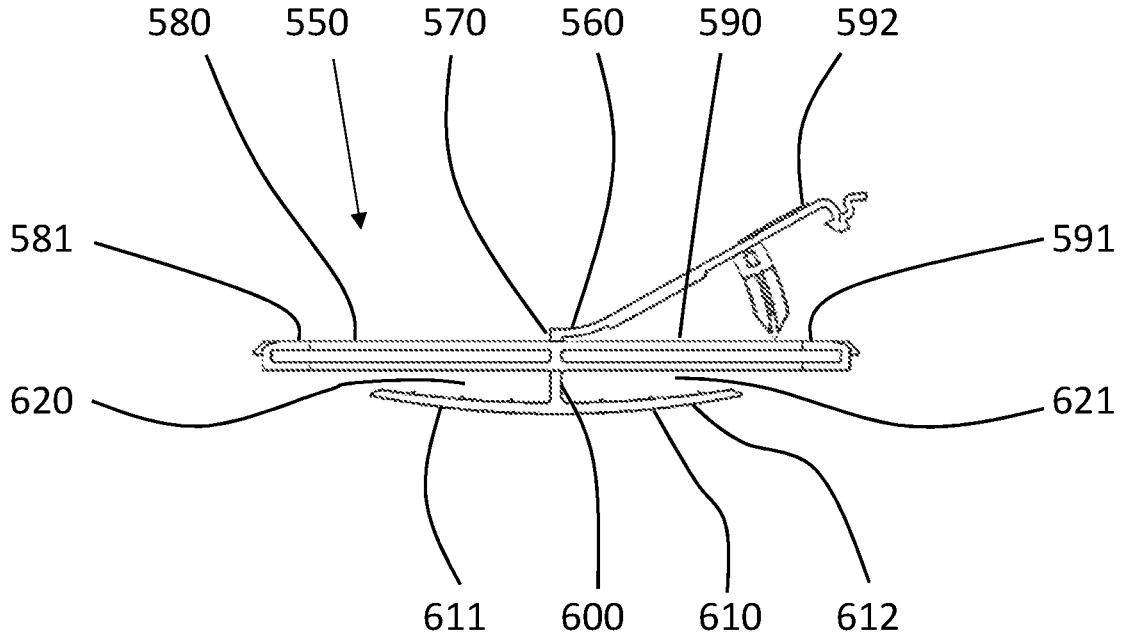
FIG. 11 is a side view of an alternative embodiment of the present invention with one arm.

Turning now to FIG. 11, it is seen that an alternative one-armed embodiment of a fastener 550 is illustrated. The fastener 550 has a top 560 with a hub 570. The hub 570 separates a first side 580 having a base 581 and no arm from a second side 590 having a base 591 and an arm 592. A web 600 separates the top 560 from a bottom 610. The bottom has two sides 611 and 612. Side 611 and side 580 define a pocket 520. Side 612 and side 590 define a pocket 621.

Figure 12:
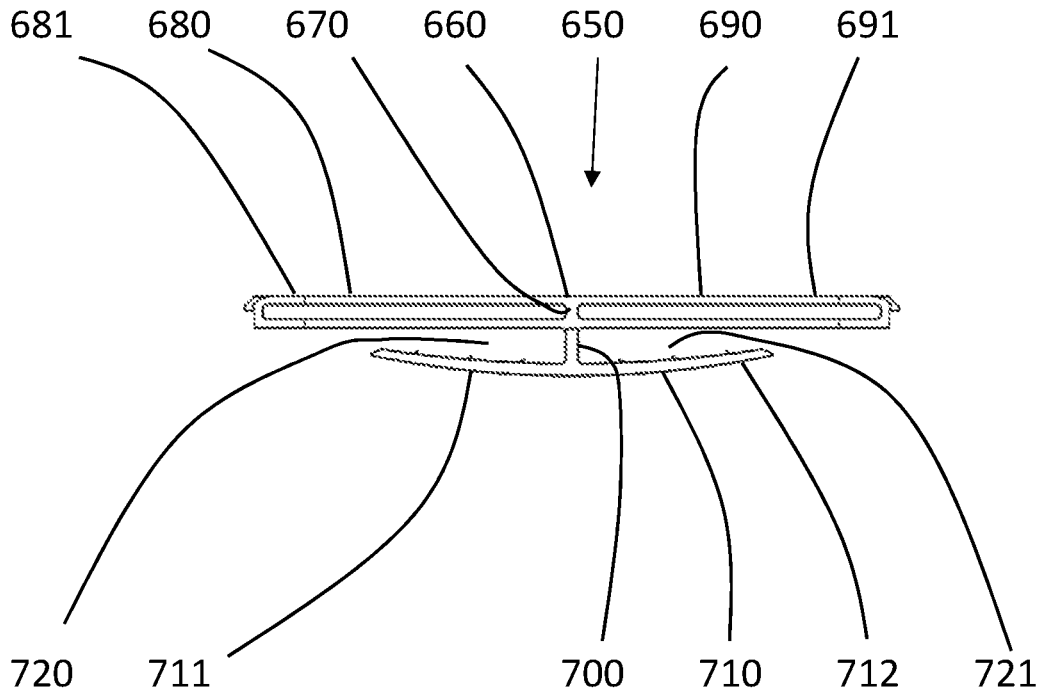
FIG. 12 is a side view of an alternative embodiment of the present invention without arms.

Turning now to FIG. 12, it is seen that an alternative embodiment of a fastener 650 is illustrated with no arms. The fastener 650 has a top 660 with a hub 670. The hub 670 separates a first side 680 having a base 681 from a second side 690 having a base 691. A web 700 separates the top 660 from a bottom 710. The bottom has two sides 711 and 712. Side 711 and side 680 define a pocket 620. Side 712 and side 690 define a pocket 721.

It is appreciated that two arm, one arm and no arm embodiments can be made from a single mold. Ports at the top of the hub location can be both open (two arm version), both closed (no arm version) or either one open (one arm versions).

Thus, it is apparent that there has been provided, in accordance with the invention, a box latch anchor that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A fastener used with a box with a box thickness, said fastener comprising:

a first side; and a second side, wherein said first side has a base with a base top piece and a base bottom piece, said base top piece and said base bottom piece being separated by a gap, and said first side further has a first side bottom separated from said base, wherein:

said fastener further comprises an arm on said first side, said arm having a piercing element;

said piercing element is curved;

said base top piece has base top piece hole; and said base bottom piece has a base bottom piece hole, said base bottom piece hole being at least one of larger than or offset from said base top piece hole, whereby said piercing element can pass through both of said base top piece hole and said base bottom piece hole when said arm is moved to a locked position.

2. The fastener of claim 1, wherein said first side bottom is curved.

3. The fastener of claim 2, wherein:

a spring force is created by deformation of said first side bottom in response to the box being inserted between said base and said first side bottom; and said first side bottom has a plurality of grips.

4. The fastener of claim 3 wherein said base bottom piece is deformable as a result of the box thickness to increase a number of said plurality of grips that contact the box.

5. The fastener of claim 2, wherein said first side bottom has a grip that is linear along a grip axis and that has a triangular profile.

6. The fastener of claim 1, wherein said fastener has one of one arm and two arms.

7. The fastener of claim 1, wherein:

said arm is movable to said locked position wherein said piercing element passes through said base top piece; and said fastener further comprises a seal passing through said gap and wrapping around said arm after said arm is moved to the locked position, said seal being broken if said arm subsequently moves to an unlocked position.

8. The fastener of claim 1, wherein said fastener comprises two arms joined together with a continuous top surface.

9. A fastener comprising:

a top having a top first side and a top second side, said top first side having a first arm and said top second side having a second arm, said first arm and said second arm having a continuous top surface therebetween;

a web; and a bottom separated from said top by said web, wherein:

said first arm has first arm piercing element;

said second arm has a second arm piercing element;

said first side further has a base, said base having a base top piece and a base bottom piece, said base top piece and said base bottom piece being separated by a gap; and said first arm piercing element passes though said base top piece and said base bottom piece when said first arm is locked.

10. The fastener of claim 9, wherein:

said base top piece has base top piece hole;

said base bottom piece has a base bottom piece hole, said base bottom piece hole being at least one of larger than or offset from said base top piece hole; and said first arm piercing element is curved.

11. The fastener of claim 9 further comprising a seal, said seal being insertable through said gap and secured around said first arm when said first arm is in a locked position, said seal being broken thereafter if said first arm is subsequently moved to an unlocked position.

12. A fastener used with a box with a box thickness, said fastener comprising:

a first side; and a second side, wherein said first side has a base with a base top piece and a base bottom piece, said base top piece and said base bottom piece being separated by a gap, and said first side further has a first side bottom separated from said base, wherein:

said fastener further comprises an arm on said first side, said arm having a piercing element, said arm is movable to a locked position wherein said piercing element passes through said base top piece; and said fastener further comprises a seal passing through said gap and wrapping around said arm after said arm is moved to the locked position, said seal being broken if said arm subsequently moves to an unlocked position.

* * * * *